US008662331B2

(12) United States Patent
Miceli et al.

(10) Patent No.: US 8,662,331 B2
(45) Date of Patent: Mar. 4, 2014

(54) ONE PIECE REVERSIBLE CLOSURE AND CONTAINER SYSTEM

(71) Applicant: Tri State Distribution, Inc., Sparta, TN (US)

(72) Inventors: David A. Miceli, Reno, NV (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 0 days.

(21) Appl. No.: 13/664,887

(22) Filed: Oct. 31, 2012

(65) Prior Publication Data

US 2013/0313254 A1 Nov. 28, 2013

Related U.S. Application Data

(63) Continuation-in-part of application No. 29/430,710, filed on Aug. 29, 2012, which is a continuation-in-part of application No. 29/422,544, filed on May 22, 2012, now Pat. No. Des. 679,598, and a continuation-in-part of application No. 29/422,556, filed on May 22, 2012, now Pat. No. Des. 680,001.

(51) Int. Cl.
*B65D 51/00* (2006.01)
*B65D 55/02* (2006.01)

(52) U.S. Cl.
CPC ..... *B65D 55/026* (2013.01)
USPC ..... 215/230; 215/228; 215/201; 220/212

(58) Field of Classification Search
CPC ..... B65D 55/026; B65D 51/248; B65D 51/24
USPC ..... 215/44, 43, 230, 228, 206, 201, 329, 215/200; 220/212, 254.8, 254.1, 296, 293, 220/288
See application file for complete search history.

(56) References Cited

U.S. PATENT DOCUMENTS

| | | | | |
|---|---|---|---|---|
| 1,100,433 | A * | 6/1914 | Johnson | 222/81 |
| 3,865,267 | A | 2/1975 | Morris | |
| 4,103,797 | A | 8/1978 | Morris | |
| D266,906 | S | 11/1982 | Guerette | |
| 4,452,364 | A | 6/1984 | Kay | |
| 4,503,987 | A * | 3/1985 | Potoff | 215/329 |
| 4,526,281 | A | 7/1985 | Herr | |
| 4,634,013 | A * | 1/1987 | Bar-Kokhba | 215/228 |
| 4,747,501 | A * | 5/1988 | Greaves | 215/253 |

(Continued)

FOREIGN PATENT DOCUMENTS

WO 2006080945 A1 8/2006

*Primary Examiner* — Robert J Hicks
(74) *Attorney, Agent, or Firm* — Luedeka Neely Group, P.C.

(57) ABSTRACT

A closure having a child resistant mode and a non-child resistant mode includes a circumferential side wall having an interior surface, a first section, a second section, and a solid divider. The solid divider is disposed between the first section and the second section for closing an opening of the container when the closure is installed on the container in the non-child resistant mode and the child resistant mode. In certain embodiments, a first liner is disposed in the first section such that the first liner is visible when the closure is installed on the container in the child resistant mode. A second liner is disposed in the second section such that the second liner is visible when the closure is installed on the container in the non-child resistant mode.

36 Claims, 12 Drawing Sheets

(56) References Cited

U.S. PATENT DOCUMENTS

| | | | | | |
|---|---|---|---|---|---|
| 4,898,293 | A | * | 2/1990 | Morel | 215/250 |
| D315,507 | S | | 3/1991 | Ochs | |
| D318,804 | S | | 8/1991 | Ochs | |
| 5,090,582 | A | * | 2/1992 | Art et al. | 215/250 |
| 5,092,477 | A | | 3/1992 | Johnson et al. | |
| 5,115,929 | A | | 5/1992 | Buono | |
| 5,329,713 | A | | 7/1994 | Lundell | |
| 5,342,093 | A | | 8/1994 | Weernink | |
| 5,464,110 | A | | 11/1995 | Heyworth | |
| 5,579,934 | A | | 12/1996 | Buono | |
| 5,711,442 | A | | 1/1998 | Kusz | |
| 5,899,348 | A | | 5/1999 | Konefal et al. | |
| 5,927,532 | A | | 7/1999 | Traub | |
| 5,958,536 | A | | 9/1999 | Gelsinger et al. | |
| 6,036,231 | A | | 3/2000 | Foote et al. | |
| 6,039,195 | A | | 3/2000 | Konefal et al. | |
| 6,240,394 | B1 | | 5/2001 | Uecker et al. | |
| 6,254,952 | B1 | | 7/2001 | Fox et al. | |
| 6,327,770 | B1 | | 12/2001 | Konefal et al. | |
| 6,368,688 | B1 | | 4/2002 | Crum et al. | |
| 6,446,823 | B2 | | 9/2002 | Miceli et al. | |
| 6,523,709 | B2 | | 2/2003 | Miceli et al. | |
| 6,715,796 | B2 | | 4/2004 | Foote et al. | |
| 6,802,427 | B2 | | 10/2004 | Miceli et al. | |
| 6,926,161 | B2 | | 8/2005 | Miceli et al. | |
| 7,000,789 | B2 | | 2/2006 | Miceli et al. | |
| 7,111,746 | B2 | | 9/2006 | Miceli et al. | |
| 7,124,904 | B1 | | 10/2006 | Miceli et al. | |
| D548,081 | S | | 8/2007 | Noonan | |
| 7,401,706 | B2 | | 7/2008 | Shingle | |
| D574,239 | S | | 8/2008 | Lin | |
| 7,823,726 | B1 | | 11/2010 | Miceli et al. | |
| 7,891,509 | B2 | | 2/2011 | Konefal | |
| 8,006,852 | B1 | | 8/2011 | Miceli et al. | |
| 8,181,370 | B1 | | 5/2012 | Miceli et al. | |
| 2002/0027120 | A1 | * | 3/2002 | Miceli et al. | 215/228 |
| 2003/0112466 | A1 | | 6/2003 | Leonardi | |
| 2006/0163869 | A1 | | 7/2006 | Adler et al. | |
| 2008/0262930 | A1 | | 10/2008 | Miceli et al. | |
| 2009/0140513 | A1 | | 6/2009 | Priebe et al. | |
| 2010/0252474 | A1 | | 10/2010 | Miceli et al. | |

* cited by examiner

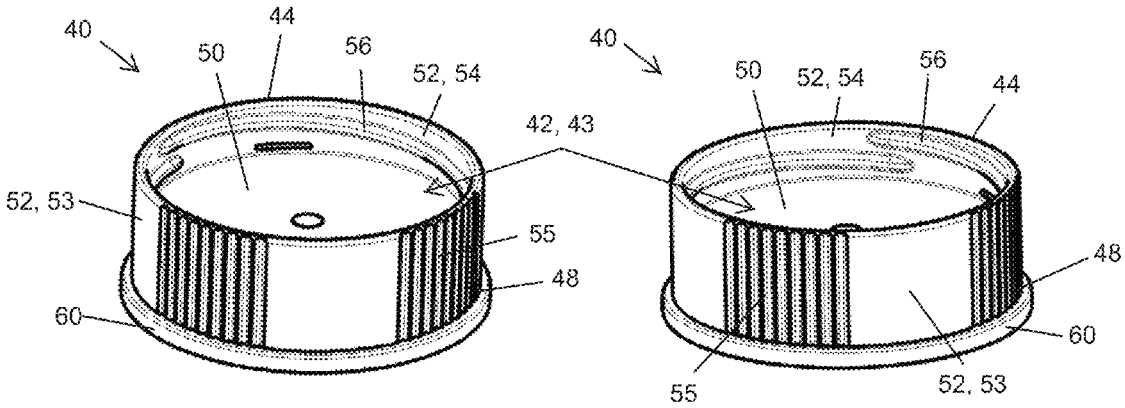
FIG. 4A
FIG. 4B
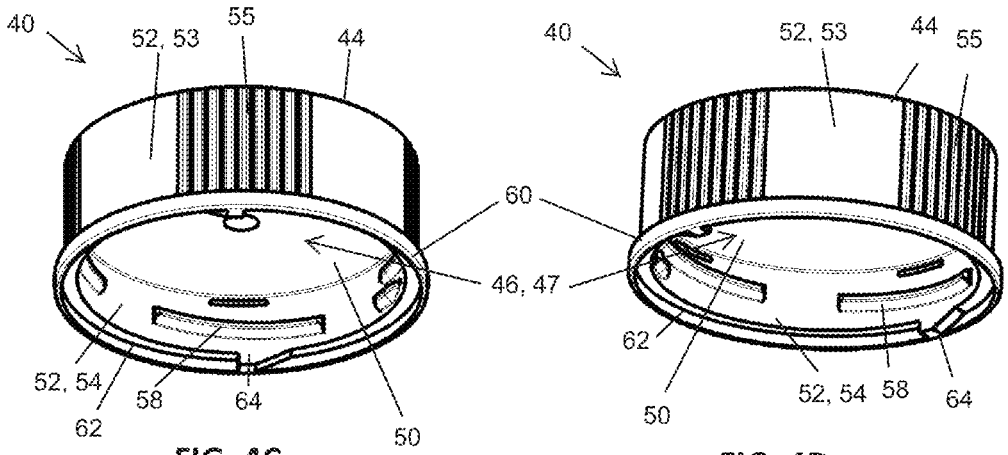
FIG. 4C
FIG. 4D

ONE PIECE REVERSIBLE CLOSURE AND CONTAINER SYSTEM

CROSS-REFERENCE TO RELATED APPLICATIONS

This application is a continuation-in-part to U.S. Design application Ser. No. 29/430,710 filed Aug. 29, 2012, and entitled "Pharmaceutical Cap," which claimed priority as a continuation-in-part of U.S. Design application Ser. No. 29/422,544, which issued as U.S. Pat. No. D 679,598, and U.S. Design application Ser. No. 29/422,556, which issued as U.S. Pat. No. D 680,001, both of which were filed May 22, 2012, and entitled "Pharmaceutical Cap," the contents of which are incorporated by reference herein in their entireties.

FIELD

This disclosure relates to a reversible child resistant closure. More particularly, this disclosure relates to a one-piece reversible child resistant closure which may be applied to a vial or other container in either a child resistant mode or a non-child resistant mode.

BACKGROUND

There are many types of child resistant closure systems described in the art. While many child resistant caps effectively provide protection against the danger of small children being able to remove potentially harmful contents, e.g. pills, from vials or other containers, they also provide a problem for a considerable portion of the adult population that require medication but lack sufficient manual dexterity or strength to remove the child resistant cap. This is of a particular concern to the elderly population or people suffering from arthritis and other disabling diseases.

Continuous threaded, torque actuated child resistant caps are a popular type of child resistant closures. These caps involve the use of two parts, one part rests above the other part in an axial configuration and requires both a rotational and downward action to engage for removal. These caps are used in literally thousands of various applications and packaging configurations due to the universally understood push and turn structures and ease of use and adaptation in a wide variety of automated filing lines and processes. Most of these prior art torque actuated child resistant closures are continuously in a child resistant mode and, therefore, can pose a problem to the segment of the population needing the pharmaceuticals contained therein, but lacking the manual dexterity or strength to open the axially, torque actuated closures.

This particular problem has been addressed by the development of closure systems having both a child resistant mode and a non-child resistant mode such that, in the non-child resistant mode, the closures are more easily opened by adults. However, many such caps have a complex, multipart structure making the caps expensive and/or difficult to convert between the child resistant and non-child resistant configurations. One example of such a closure is disclosed in U.S. Pat. No. 5,579,934, (the '934 patent). The '934 patent proposes a container closure that is selectively manipulatable between a configuration which resists opening by children and a configuration which may be easily opened without special manipulation of the closure. Specifically, the closure is manipulated into its non-child resistant mode by "pressing down" on the central portion of the top surface of the closure.

Although this type of closure provides an advance in the art of protection against the danger of small children being able to remove it from vials or other containers, the cap is made with two separately manufactured pieces that must be assembled. These aspects of the cap of the '934 patent, as well as other caps sharing these aspects, increases both the manufacturing cost and assembly time for the caps. Further, these caps cannot be sealed with tamper resistant liners in an induction sealing process as the two-piece cap includes an inner component that protrudes into the opening of the container and would break the seal.

Additionally, many caps that are convertible between a child resistant mode and non-child resistant mode have lacked the capability to properly include a warning to the consumer once this closure has been converted to its non-child resistant configuration. This warning, or message, is normally required by the Consumer Product Safety Commission to alert users that the closure has been converted into the non-child resistant configuration.

In light of the foregoing, what is needed in the art is a reversible one piece child resistant closure and one piece child resistant closure and container system that is efficient to manufacture and use. The closure and container system preferably should provide a warning to the user when the closure system is in a non-child resistant mode and is operable to be used in conjunction with an induction sealing system.

SUMMARY

A closure is disclosed for use with a container having a neck including a container engaging structure and a container locking mechanism. The closure has a child resistant mode when applied to the container in a child resistant configuration and a non-child resistant mode when applied to the container in a non-child resistant configuration. The closure includes a circumferential side wall having an interior surface, a first section, a second section, and a solid divider. The first section includes a first closure engaging structure disposed on the interior surface of the circumferential side wall configured to contact and interact with the container engaging structure when the closure is in the non-child resistant configuration. The second section includes a second closure engaging structure disposed on the interior surface of the circumferential side wall configured to contact and interact with the container engaging structure when the closure is in the child resistant configuration and a closure locking mechanism configured to engage the container locking mechanism for restricting axial movement of the closure with respect to the container when the closure is in the child resistant mode. The solid divider is disposed between the first section and the second section for closing an opening of the container when the closure is installed on the container in the non-child resistant mode and the child resistant mode. In preferred embodiments, the circumferential side wall, first section, second section, and divider are formed as a unitary one-piece closure.

According to some embodiments, the first closure engaging structure is a continuous thread and the second closure engaging structure is a segmented thread. In other embodiments, both the first closure engaging structure and the second closure engaging structure are segmented threads.

According to certain embodiments, no part of the closure extends into the opening of the container when the closure is installed on the container in the child resistant mode and the non-child resistant mode. The closure may also include a tamper resistant liner configured to be inserted adjacent the divider in one of the first section and the second section for sealing the opening of the container in an induction sealing process.

According to some embodiments, warning indicia is molded into the divider such that the warning information is visible when the closure is in the non-child resistant mode. In other embodiments, the closure includes a first liner and a second liner, the first liner configured to be inserted into the first section such that the first liner is visible when the closure is installed on the container in the child resistant mode and the second liner configured to be inserted into the second section such that the second liner is visible when the closure is installed on the container in the non-child resistant mode. The second liner preferably includes warning indicia indicating that the closure is in the non-child resistant mode.

According to other embodiments, the divider is at least partially see-through and the closure includes a liner having a first side and a second side. The liner is configured to be inserted in one of the first section and the second section such that the first side is viewable when the closure is installed on the container in the non-child resistant mode and the second side is viewable when the closure is installed on the container in the child resistant mode. The first side of the liner preferably includes warning indicia indicating that the closure is in the non-child resistant mode.

According to another embodiment of the disclosure, a reversible child resistant closure system having a child resistant mode and a non-child resistant mode is disclosed. The reversible child resistant closure system includes a container and a unitary one piece closure. The container includes a neck having a container engaging structure disposed on an outer surface of the neck and a container locking mechanism. The unitary one piece closure includes a circumferential side wall having an interior surface, a first section, a second section, and a solid divider. The first section has a first closure engaging structure disposed on the interior surface of the circumferential side wall configured to contact and interact with the container engaging structure when the closure is installed on the container in a non-child resistant configuration. The second section includes a second closure engaging structure disposed on the interior surface of the circumferential side wall configured to contact and interact with the container engaging structure when the closure is installed on the container in a child resistant configuration and a closure locking mechanism configured to engage the container locking mechanism for restricting axial movement of the closure with respect to the container when the closure is installed on the container in the child resistant mode. The solid divider is disposed between the first section and the second section for closing an opening of the container when the closure is installed on the container in the non-child resistant mode and the child resistant mode.

According to some embodiments, the container is injection molded. In other embodiments, the container is blow molded.

According to another embodiment of the disclosure, a closure for use with a container having a neck including a container engaging structure and a container locking mechanism is disclosed. The closure has a child resistant mode when applied to the container in a child resistant configuration and a non-child resistant mode when applied to the container in a non-child resistant configuration. The closure includes a circumferential side wall having an interior surface, a first section, a second section, and a solid divider. The first section includes a first engaging thread disposed on the interior surface of the circumferential side wall configured to interact with the container engaging structure when the closure is installed on the container in the non-child resistant configuration. The second section includes a second engaging thread disposed on the interior surface of the circumferential side wall configured to interact with the container engaging structure when the closure is installed on the container in the child resistant configuration and a closure locking mechanism configured to engage the container locking mechanism for restricting axial movement of the closure with respect to the container when the closure is installed on the container in the child resistant mode. The solid divider is disposed between the first section and the second section for closing an opening of the container when the closure is installed on the container in the non-child resistant mode and the child resistant mode. The closure according to this embodiment also includes a first liner and a second liner. The first liner is disposed in the first section having first liner indicia printed thereon such that the first liner indicia is visible when the closure is installed on the container in the child resistant mode. The second liner is disposed in the second section having second liner indicia printed thereon such that the second liner indicia is visible when the closure is installed on the container in the non-child resistant mode.

According to some embodiments, the circumferential side wall, first section, second section, and divider are formed as a unitary one-piece closure. The second liner indicia preferably includes warning indicia indicating that the closure is in the non-child resistant mode, and the first liner and/or second liner indicia may include promotional information.

According to yet another embodiment of the disclosure, a closure for use with a container having a neck including a container engaging structure and a container locking mechanism is disclosed. The closure has a child resistant mode when applied to the container in a child resistant configuration and a non-child resistant mode when applied to the container in a non-child resistant configuration. The closure includes a circumferential side wall having an interior surface, a first section, a second section, and a solid divider. The first section includes a first closure engaging structure disposed on the interior surface of the circumferential side wall configured to contact and interact with the container engaging structure when the closure is in the non-child resistant configuration. The second section includes a second closure engaging structure disposed on the interior surface of the circumferential side wall configured to contact and interact with the container engaging structure when the closure is in the child resistant configuration and a closure locking mechanism configured to engage the container locking mechanism for restricting axial movement of the closure with respect to the container when the closure is in the child resistant mode. The solid divider disposed between the first section and the second section for closing an opening of the container when the closure is installed on the container in the non-child resistant mode and the child resistant mode. The solid divider is at least partially transparent, and the circumferential side wall is substantially opaque.

According to some embodiments, the circumferential side wall, first section, second section, and divider are formed as a unitary one-piece closure. The closure includes a liner including a first side and a second side. The liner is configured to be inserted in one of the first section and the second section such that the first side is viewable when the closure is installed on the container in the non-child resistant mode and the second side is viewable when the closure is installed on the container in the child resistant mode.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein:

FIGS. 4A-4D are side perspective views of a closure of a reversible child resistant closure system according to one embodiment of the disclosure, oriented with a non-child resistant section located on the top and a child resistant section located on the bottom according to another embodiment of the disclosure;

DETAILED DESCRIPTION

The disclosure relates to a reversible child resistant closure system primarily directed for use with containers intended to store and dispense pharmaceutical products and the like. However, the system may also be used with containers intended to have a child resistant mode and a non-child resistant mode irrespective of its contents.

Figure 1A:
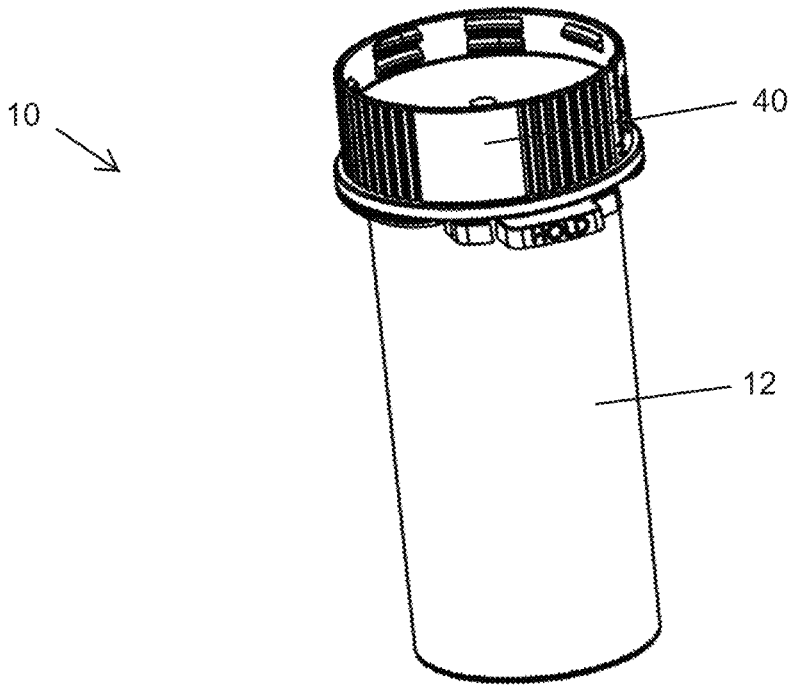
FIG. 1A is a side perspective view of a reversible child resistant closure system in a child resistant mode according to one embodiment of the disclosure.
Figure 1B:
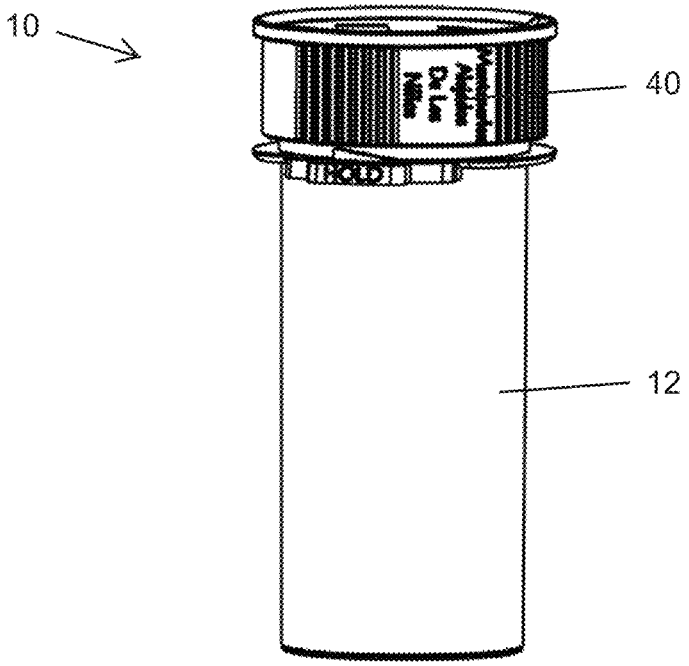
FIG. 1B is a side perspective view of a reversible child resistant closure system in a non-child resistant mode according to one embodiment of the disclosure.

Referring first to FIGS. 1A-1B, there is shown a reversible child resistant closure system 10 according to the disclosure. FIG. 1A shows the closure system 10 in its child resistant mode, and FIG. 1B shows the same closure system 10 in its non-child resistant mode. The closure system 10 includes a container 12 and a one piece reversible child resistant closure 40.

Figure 2:
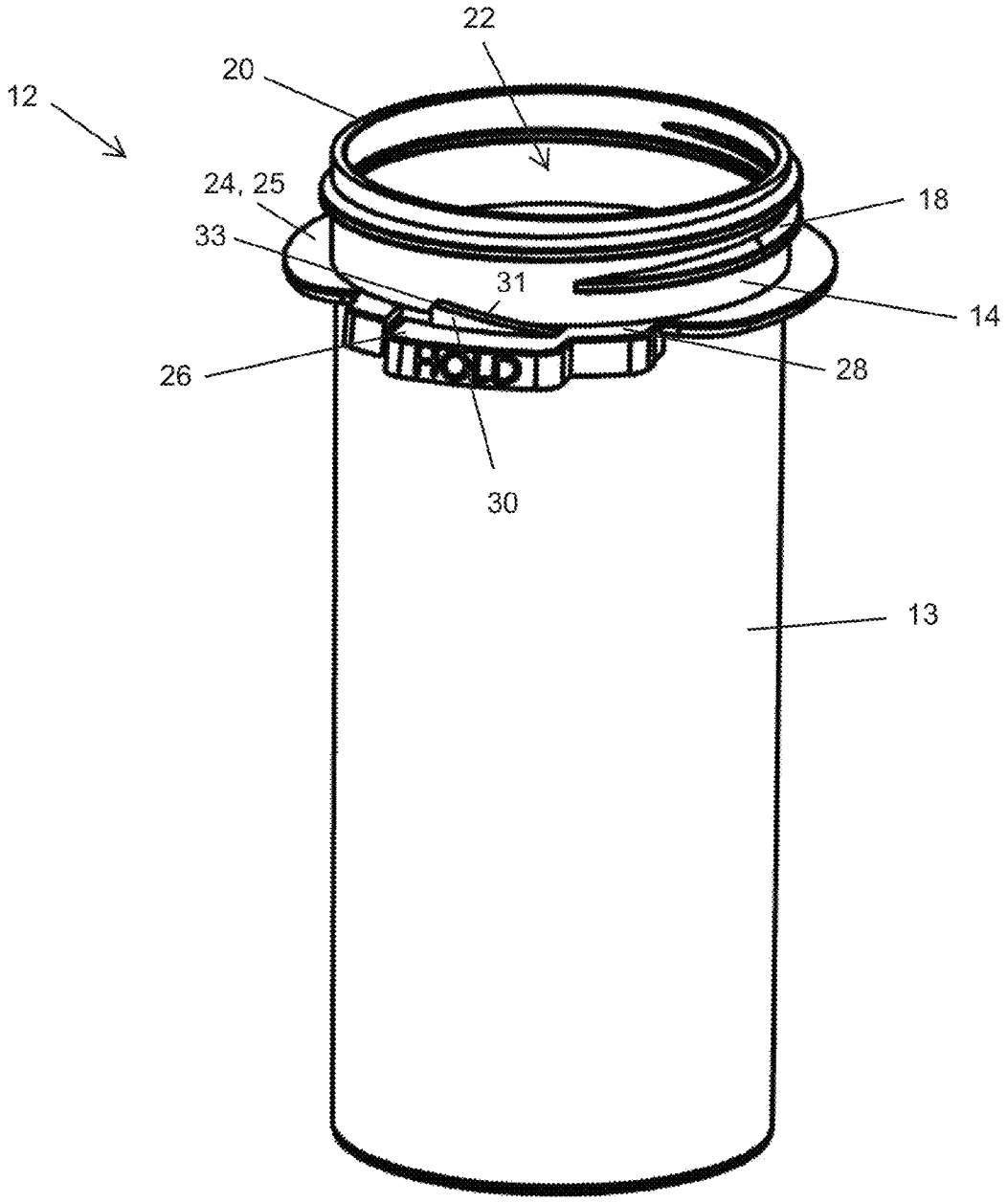
FIG. 2 is a side perspective view of a container of a reversible child resistant closure system according to one embodiment of the disclosure.

Referring to FIG. 2, the container 12 includes a body 13 and a neck 14. The neck 14 includes a container engaging structure 18 disposed on an exterior of the neck 14, a container opening edge 20 defining a container opening 22, and a bottom edge 24 opposite the container opening edge 20. In preferred embodiments, the bottom edge 24 of the neck 14 is defined by a rim 25. In some embodiments, the neck 14 may have substantially the same diameter as the body 13. However, in other embodiments, the neck 14 may have a smaller diameter than the body 13 of the container 12. The engaging structure 18 is operable to interact with a corresponding structure on the reversible child resistant closure 40 to secure the closure 40 to the container 12. In preferred embodiments, as shown in FIG. 2, the engaging structure 18 includes one or more threads. However, other suitable engaging structures 18 may be used including beads, cams, lugs and the like.

Disposed adjacent the bottom edge 24 of the neck 14 is a container locking mechanism configured to interact with a corresponding closure locking mechanism for preventing axial movement of the closure 40 when the closure system 10 is in the child resistant mode.

As shown in FIG. 2, one embodiment of the container locking mechanism includes one or more deflectable locking structures 26 disposed at an interruption of space in the rim 24. A locking lug 30 extends from a top surface 28 of the locking structure 26 towards the opening edge 20 of the container 12 for releasably engaging a corresponding locking lug of the reversible child resistant closure 40. For clarification purposes, the locking lug 30 of the container 12 is referred to herein as a locking tab, and the corresponding locking lug of the closure 40 is referred to as a locking projection. In order for the locking tab 30 to releasably engage the corresponding locking projection of the closure 40, the locking structure 26 is yieldable or deflectable relative to the neck 14. This deflection of the locking structure 26, as will be further described below, allows for engagement or disengagement of the locking tab 30 from the locking projection of the closure 40 to allow for either child locking or disengagement of the closure 40 with respect to the container 12. For ease of manufacturing of a container having the deflectable locking structure 26, the container 12 is preferably injection molded. However, it should be noted that other types of locking mechanisms may be utilized within the scope of the disclosure including locking mechanisms for blow molded containers.

Referring to FIGS. 3A-3D and FIGS. 4A-4D, the one piece closure 40 includes a first section 42 having a first edge 44 and a second section 46 having a second edge 48. The first section 42 and second section 46 are separated by a solid divider 50 which prevents pharmaceuticals or other materials from exiting the opening 22 of the container 12 whether the one piece closure 40 is used in a child resistant configuration or a non-child resistant configuration. A circumferential side wall 52 extends around the outer circumference of the closure 40 extending from the first edge 44 of the first section 42 to the second edge 48 of the second section 46. The solid divider 50 and side wall 52 forms a first section cavity 43 extending between the first edge 44 and the divider 50 and a second section cavity 47 extending from the second edge 48 to the divider 50. As shown, the diameter of the circumferential side wall 52 is preferably substantially the same throughout the height of the closure 40.

The exterior surface 53 of the side wall 52 preferably includes a gripping structure such as a plurality of knurls 55 for assisting a user to grip and rotate the closure 40 relative to the container 12. The interior surface 54 of the side wall 52 of both the first section 42 and the second section 46 includes respective engaging structures 56, 58 operable to interact for rotatable engagement with the complementary engaging structure 18 on the container 12 to secure the closure 40 to the container 12. Referring to FIG. 1A, when the closure 40 is applied to the container 12 in the child resistant configuration, engaging structure 58 of the closure 40 interacts with the engaging structure 18 of the container 12.

Referring to FIG. 1B, when the closure 40 is inverted and applied to the container in the non-child resistant configuration, engaging structure 56 of the closure 40 interacts with the engaging structure 18 of the container 12. As shown in the Figures, the engaging structures 56 and 58 are preferably solid or segmented threads. However, other suitable engaging structures 56, 58 may be used as long as they are operable to interact with the engaging structure 18 of the container 12.

Figure 6:
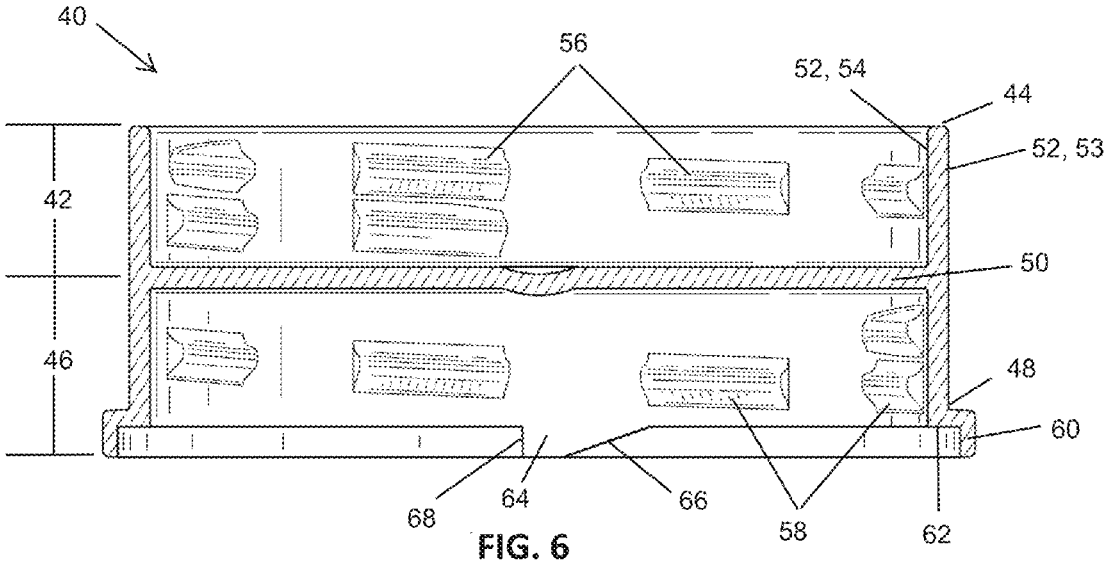
FIG. 6 is a side cross-sectional view of the closure according to one embodiment of the disclosure.

In the embodiment shown in FIGS. 3A-3D, both of the engaging structures 56 and 58 of the closure 40 includes a segmented thread for interacting with the threaded engaging structure 18 of the container 12. To assist in manufacturing the closure 40 of this embodiment, the thread segments 56 of the first section 42 are preferably vertically aligned with the thread segments 58 of the second section 46 as shown in the cross-sectional view of FIG. 6. Lifter bars are preferably used to make the segmented threads 56, 58 in an injection molding process.

In an alternate embodiment, as shown in FIGS. 4A-4D, the engaging structure 56 of the first section 42 is a single continuous thread while the engaging structure 58 of the second section 46 is a segmented thread. In this embodiment, during manufacture, the thread segments 58 of the second section 46 are preferably made using lifter bars, and the lifter bars will pull on the thread segments 58 of the second section to bump the closure 40 off the mold. The thread segments 58 of the second section 46 are preferably between about 0.75 inches to about 1.25 inches long depending on the size of the closure 40. However, as shown in FIGS. 3A-3D, smaller thread segments may be used for either the first section 42 or the second section 46.

Figure 3A:
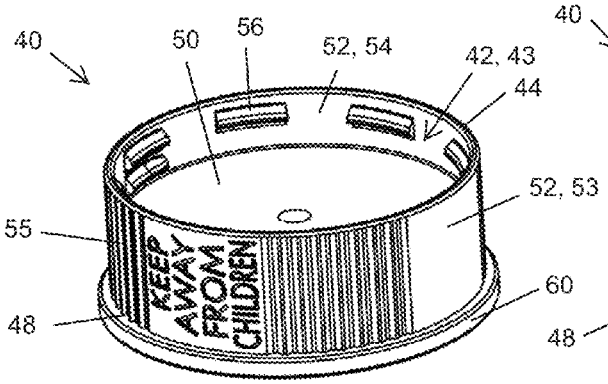
FIGS. 3A-3D are side perspective views of a closure of a reversible child resistant closure system according to one embodiment of the disclosure, oriented with a non-child resistant section located on the top and a child resistant section located on the bottom according to one embodiment of the disclosure.
Figure 3B:
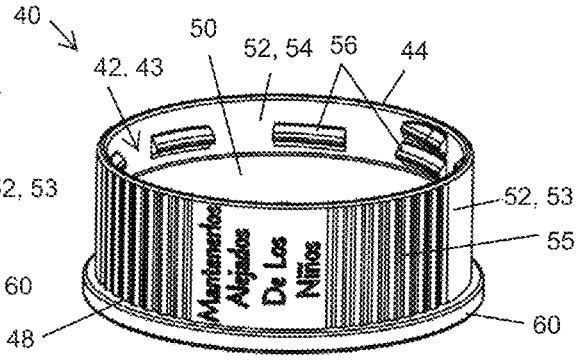
Figure 3C:
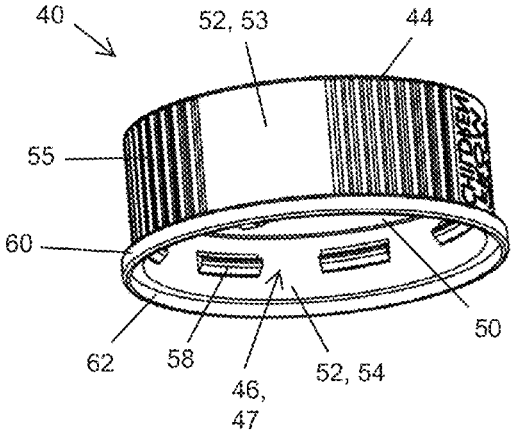
Figure 3D:
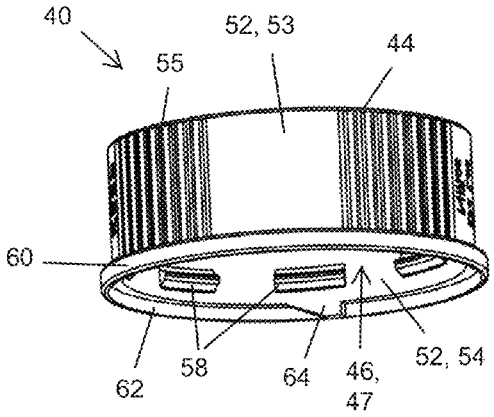

Referring to FIGS. 3D and 4D, the second section 46 includes a flange 60 extending radially from the side wall 52 axially downward from the second edge 48. At least one locking projection 64 extends radially inward from the inner surface 62 of the flange 60. The locking projection 64 is operable to engage the locking tab 30 of the container 12 for preventing the closure 40 from rotating with respect to the container 12. When the closure 40 is applied to the container 12 in the child resistant configuration and the locking projection 64 of the closure 40 engages the locking tab 30 of the container 12, the closure system 10 is in the child resistant mode. In order to remove the closure 40 from the container 12, a user must deflect the locking structure 26 so that the locking projection 64 disengages the locking tab 30. For example, the locking structure 26 may be deflected downward by a thumb of the user.

Figure 5:
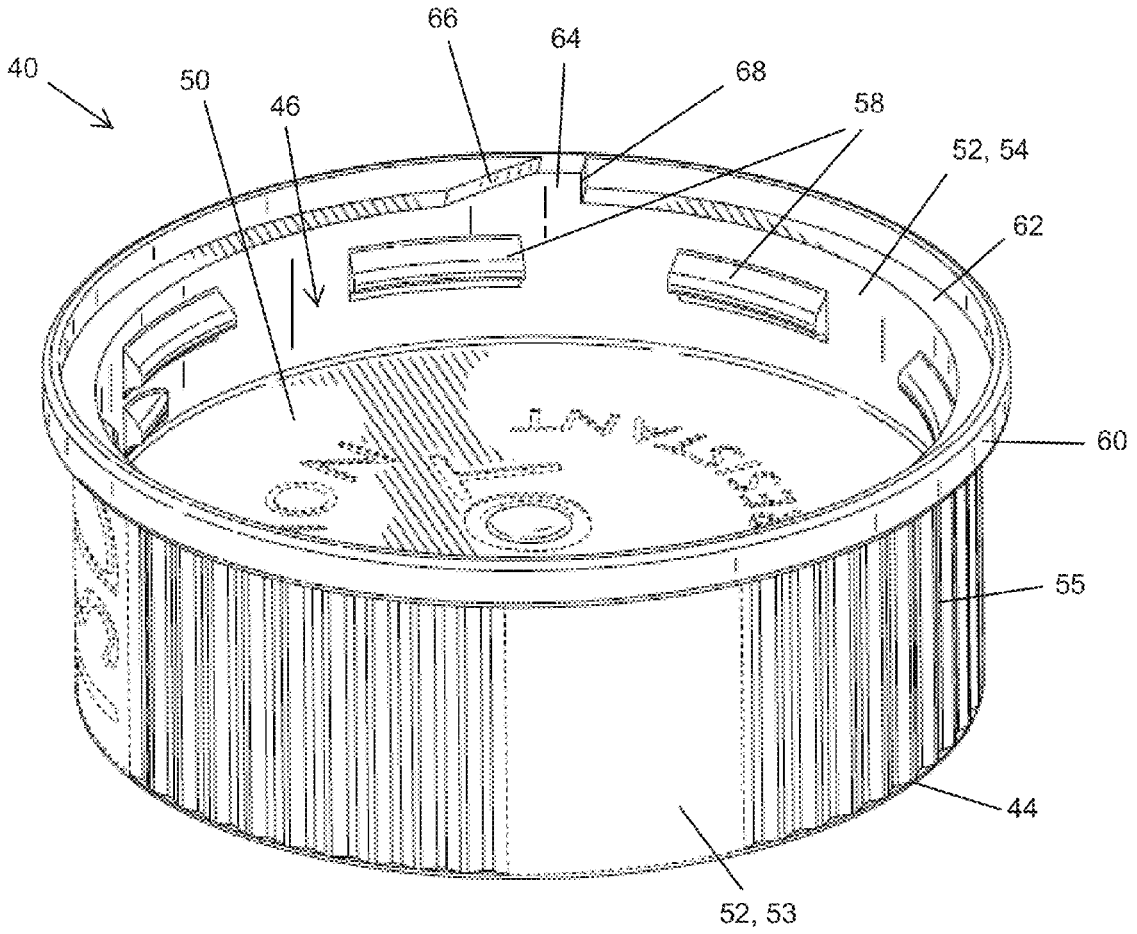
FIG. 5 is a perspective view of the closure oriented so that the child resistant side is facing upward according to one embodiment of the disclosure.
Figure 7:
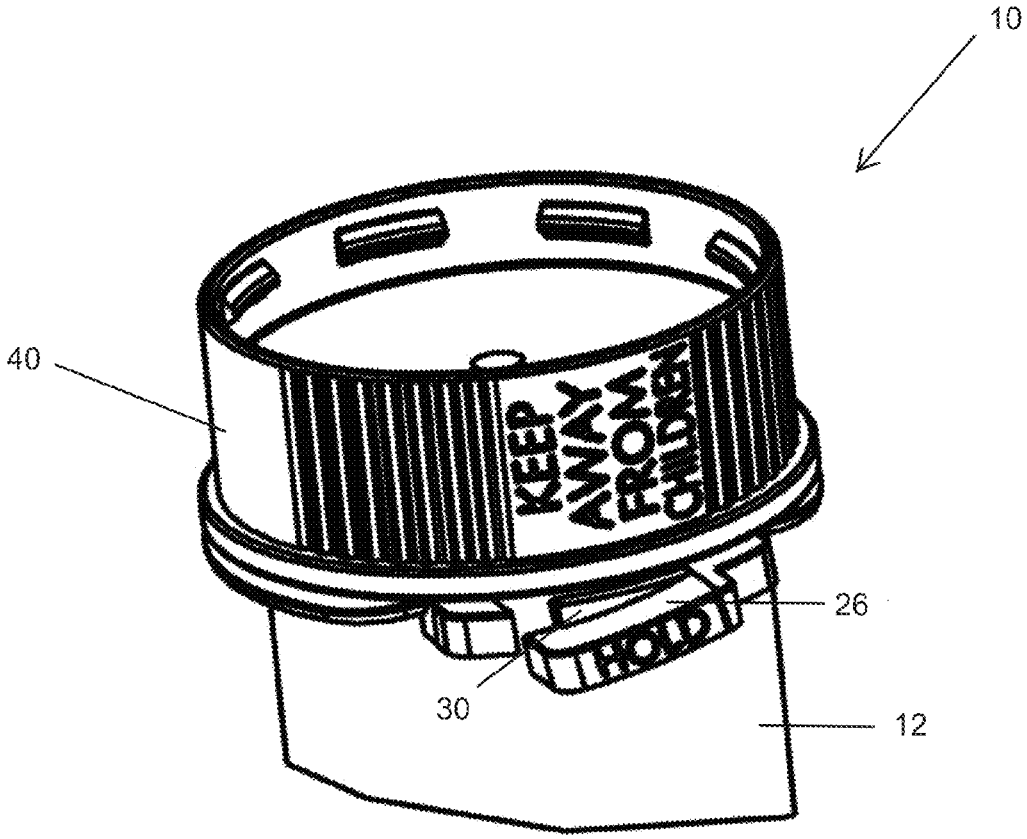
FIG. 7 is side perspective view of the closure being applied to a container in the child resistant configuration according to one embodiment of the disclosure.

In certain embodiments, as shown in FIG. 2, the locking tab 30 of container 12 includes a ramp or inclined surface 31 and a locking edge 33. Referring to FIG. 5, the locking projection 64 of closure 40 also includes a ramp or inclined surface 66 and a locking edge 68. In operation, the closure 40, when applied to the container 12 in the child resistant configuration, is rotated in a closing direction, preferably clockwise, about the neck 14 of container 12 until the locking projection ramp 66 traverses the locking tab ramp 31. Referring to FIG. 7, to assist the locking projection ramp 66 in traversing the locking tab ramp 31, the locking structure 26 and corresponding locking tab 30 of the container 12 is deflected downward as the locking projection ramp 66 travels across the locking tab ramp 31.

Figure 8:
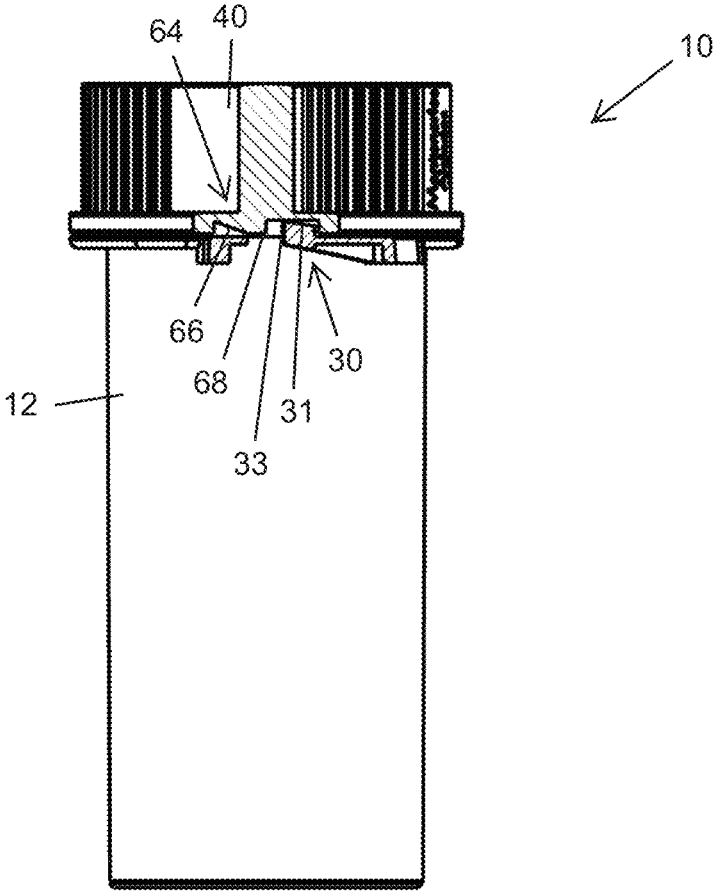
FIG. 8 is side cross-sectional view of a reversible child resistant closure system in the child resistant mode according to one embodiment of the disclosure.

Referring to FIG. 8, showing a cross-sectional view of the closure system 10 in the child resistant mode where the locking projection 64 is engaging the locking tab 30, the locking edge 33 of the locking tab 30 and the locking edge 68 of the locking projection 64 prevent the closure 40 from rotating in an opening direction, the opening direction preferably being counter-clockwise. In order to allow counter-clockwise rotation of the closure 40 for removing the closure 40 from the container 12, a user holds down or otherwise deflects the locking structure 26 so that the locking projection 64 may traverse the locking tab 30.

In a non-child resistant operation, the closure 40 is inverted 180 degrees so that it may be applied to the container 12 in the non-child resistant configuration as shown in FIG. 1B. As the first section 42 of the closure 40 does not include a locking tab or any other type of structure that would engage the locking structure 26 of the container 12, the closure 40 is operable to freely move in both a clockwise and counter-clockwise direction.

Figure 9:
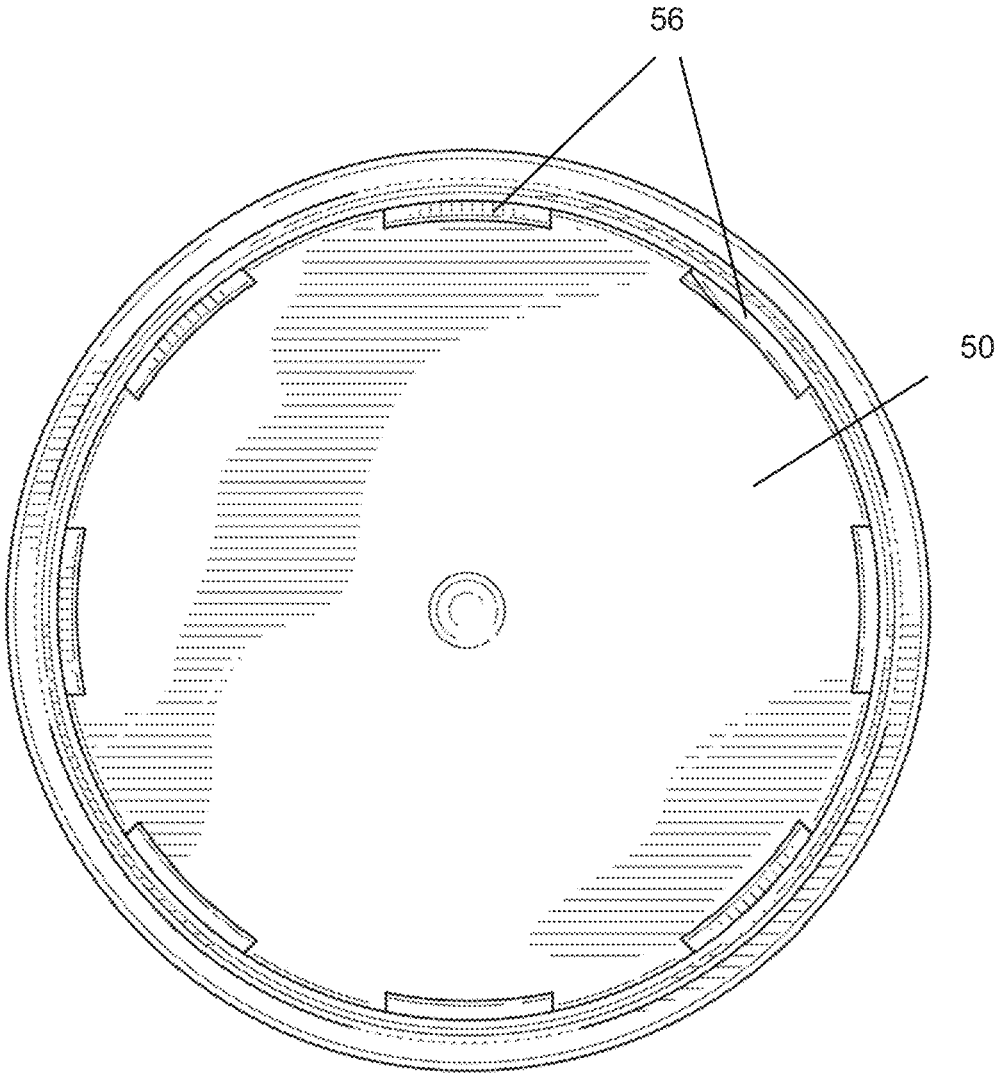
FIG. 9 is a top plan view of the closure with the non-child resistant side facing up according to one embodiment of the disclosure.
Figure 10:
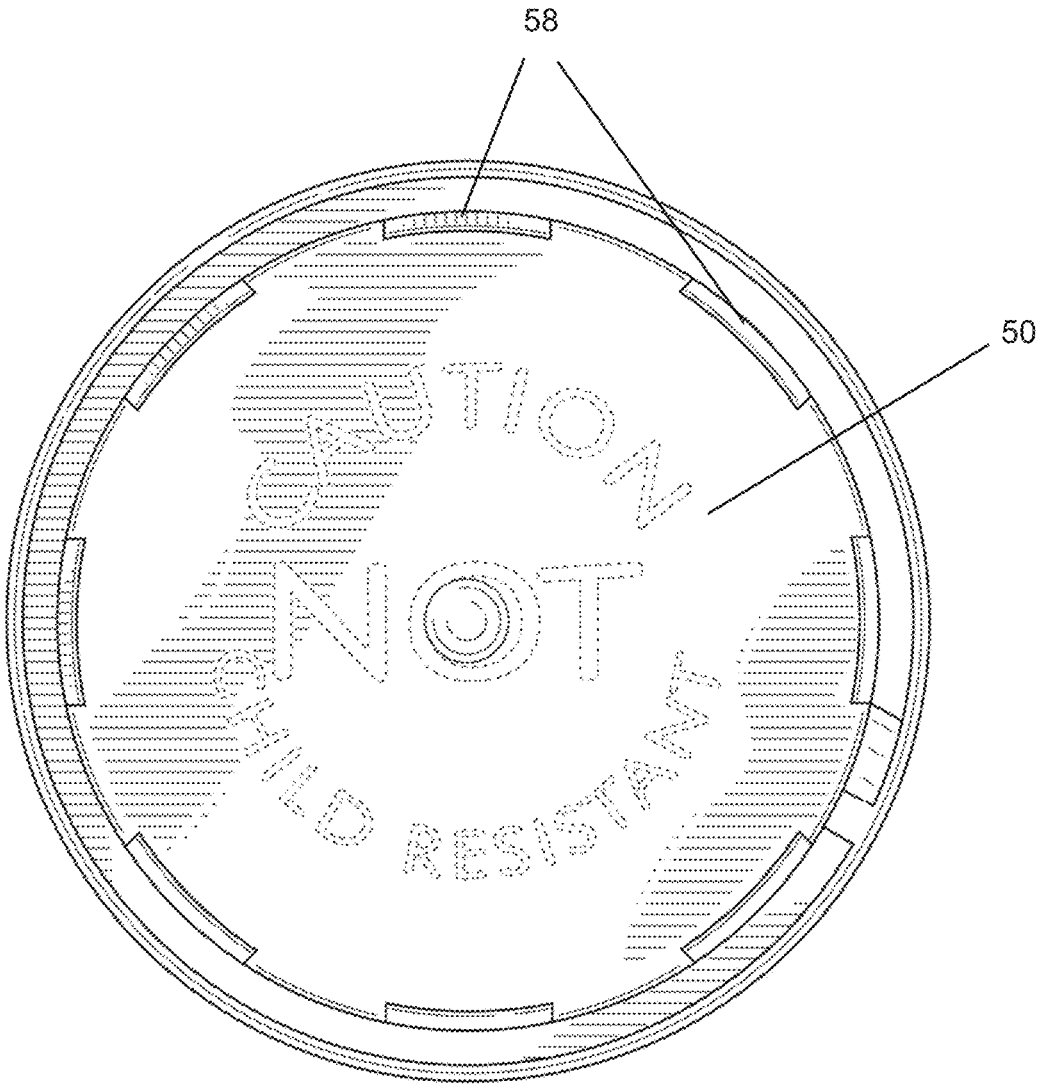
FIG. 10 is a top plan view of the closure with the child resistant side facing up according to one embodiment of the disclosure.

Referring to FIGS. 9-10, the divider 50 is seen from above when the closure system 10 is in either the child resistant mode (FIG. 9) or the non-child resistant mode (FIG. 10). Indicia, such as company branding, may be molded into one or both sides of the divider 50. As shown in FIG. 10, a warning that closure system 10 is in the non-child resistant mode is preferably molded into the second section side of the divider 50 such that the warning is visible when the closure system 10 is in the non-child resistant mode.

As explained above, the divider 50 disposed between the first section 42 and second section 46 forms a first section cavity 43 and a second section cavity 47. Thus, each cavity is configured to easily receive liners 70 for providing information to the user of the child resistant closure system 10. The liners 70 are preferably shaped in the form of a disc so that they may be positioned adjacent to and parallel the divider 50 in the first section 42, the second section 46, or both the first section 42 and the second section 46 of the closure 40. To easily secure the liners without glue or other adhesives, the liners preferably include a diameter that is substantially the same as the diameter of the side wall 52.

Referring to FIGS. 11A-11D, a first liner 72 is inserted into the first section cavity 43 such that the first liner is viewed when the closure system 10 is in the child resistant mode, and a second liner 74 is inserted into the second section cavity 47 such that the second liner 74 is viewed when the closure system 10 is in the non-child resistant mode. Thus, a liner 70 is able to be displayed to a user of the closure system 10 no matter which configuration, child resistant or non-child resistant, the closure 40 is applied to the container 12. When inserted into a section cavity, the liner would cover up any information that is molded into the respective side of the divider 50. Alternatively, the use of liners 70 could replace the step of molding or printing information into the actual divider 50.

Figure 11A:
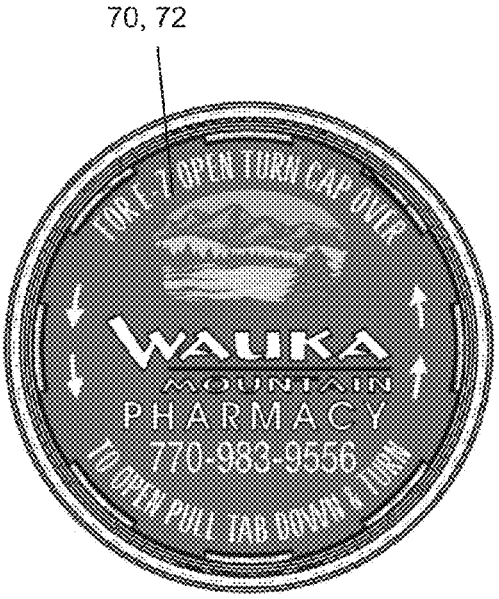
FIGS. 11A-11D are top views of the closure having various liners according to embodiments of the disclosure.
Figure 11B:
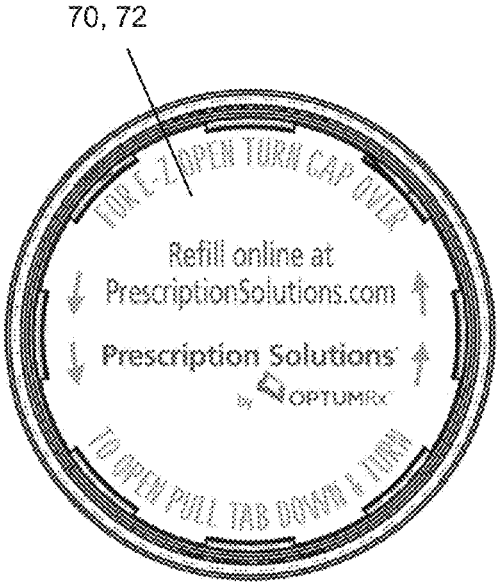

Printed on each liner 70 may be information that includes, for example, one or more of company branding, messages, advertisements, QR (quick response) codes, and prescription information. Referring to FIG. 11A, the first liner 72 is shown having promotional information in the form of pharmacy branding as well as operating instructions instructing the user, for example, "TO OPEN PULL TAB DOWN & TURN" and directing the user to turn the cap over for operating in the non-child resistant mode. Referring to FIG. 11B, another embodiment of the first liner 72 depicts promotional information directing the user to a website for refilling prescriptions as well as the operating instructions shown in FIG. 11A.

Figure 11C:
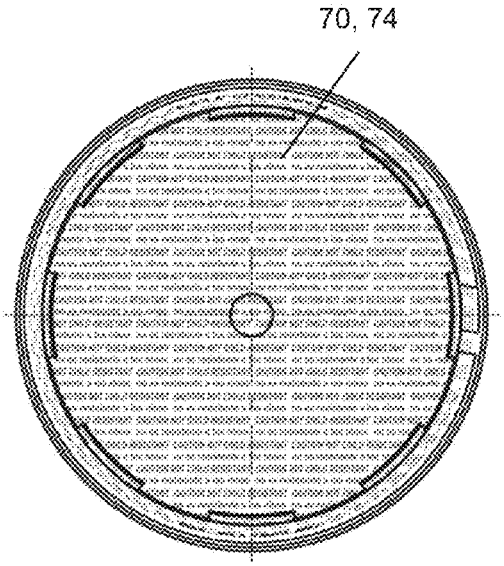
Figure 11D:
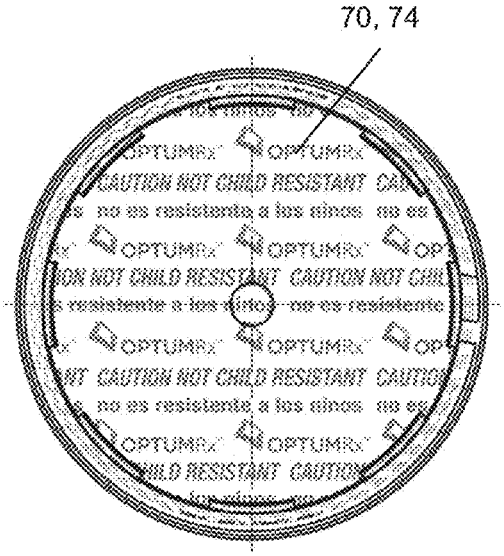
Figure 12A:
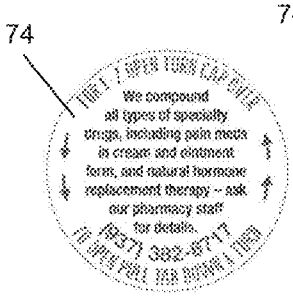
FIGS. 12A-12D are top views of various liners according to embodiments of the disclosure.
Figure 12B:
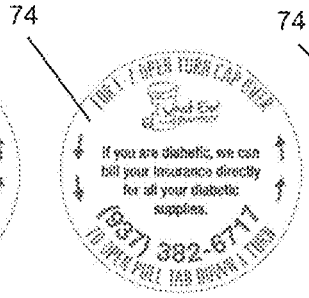
Figure 12C:
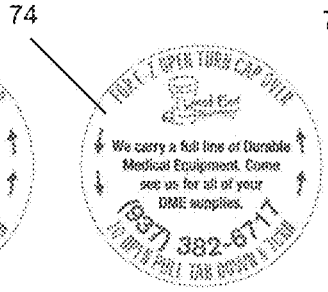
Figure 12D:
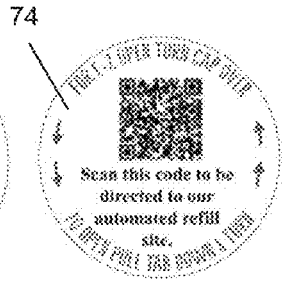

Referring to FIGS. 11C-11D, the second liner 74 is preferably provided with warning indicia, for example, "CAUTION NOT CHILD RESISTANT," for indicating to the user that the child resistant closure system 10 is currently in the non-child resistant mode. As shown in FIG. 11D, other information may also be provided in addition to the warning indicia such as pharmacy branding or other promotional materials.

Referring to FIGS. 12A-12D, various non-limiting examples of advertisements or promotional material capable of being displayed on a liner 70 are shown. While the liners 70 shown are first liners 72 to be inserted in the first section cavity 43 as they include operating instructions, the promotional material may also be provided on second liners 74 to be inserted in the second section cavity 47 by replacing the operating instructions with warning indicia. As shown, the liners 70 may include advertisements specifically directed to goods or services that are related to the pharmaceutical in the container, or the advertisement can be specifically directed at items that the user may associate with the pharmaceuticals dispensed in the closure system 10. For example, advertisements directed at diabetic testing equipment can be positioned on a pharmaceutical container that carries a prescription of diabetic medicine therein. As such the advertisements can be user specific.

Alternately, the advertisements can be general to a specific location such as local businesses within a predetermined distance of the pharmacy or the actual pharmacy where the closure system 10 was purchased. Specific items can be advertised, such as specials for a particular business, such as the pharmacy where the closure system 10 was purchased. Additionally, codes, such as QR codes, can be added to the advertising. These codes can be scanned by a user's smart phone or other code scanner to direct them to pharmacy web pages, coupons, etc. accessible over the Internet.

In addition to the promotional material, or in replacement of the promotional material, the liner 70 may also include prescription information directed specifically to the medication provided in the closure system. For example, the liner 70 may include an identification of the pharmaceutical stored in the closure system, dosage information such as "Take One Pill A Day," and/or auxiliary information such as "Do Not Take With Dairy." Further, the a variety of liners 70 may be provided in a each in a different color that corresponds to particular dosage instructions for the prescribed pharmaceutical in order to further enhance compliance with a prescription. For example, one liner 70 may include the instructions such as "REMINDER: TAKE 2 PILLS IN THE A.M.," and this liner would have green characters. Another liner 70 may be provided for a separate prescription that provides "REMINDER: TAKE 2 PILLS IN THE P.M.," and this liner could have red character to distinguish it from the prescription that is to be taken in the morning.

According to an alternate embodiment, the divider 50 is made of a clear plastic or other see-through material and the side wall 52 is preferably made from a substantially opaque material or matte finish. In this embodiment, the closure 40 is preferably formed as a unitary one piece structure using a two stage injection molding process in which the opaque side wall 52 resin is injected separately from the transparent divider 50. In another embodiment, the difference in transparency between the divider 50 and the side wall 52 is controlled by using only a single stage injection process and varying the surface finish on the mold itself. Thus, the steel of the mold that forms the divider 50 would be highly polished (yielding a clear, see-through portion) while the steel forming the side wall 52 would be left rough (yielding a matte, opaque finish). The opaque side wall 52 prevents visibility of the interface of the engaging sections to inhibit opening by children who might be able to see the interference if the entire cap was transparent. In this embodiment, liner 70 may include warning indicia on one side of the liner 70 with or without additional information on the opposite side. As the divider 50 is see-through or at least partially transparent in this embodiment, one side of the liner 70 is always visible no matter which configuration the closure 40 is applied to the container 12. Accordingly, the liner 70 may be inserted into either the first section 42 or the second section 46 such that the side of the liner having warning indicia printed thereon is displayed while looking down on the closure 40 when the child resistant closure system 10 is in the non-child resistant mode, and the other side, preferably having the additional information printed thereon, is displayed when the child resistant closure system 10 is in the child resistant mode.

In automatic filling applications, the liners 70 are preferably printed digitally with variable data so that the graphics and/or message of the displayed on the liner may be changed rapidly during the printing process. During manufacturing of the closures 40, the various liners 70 may then be inserted into the caps randomly or in sequence in such a way that boxes of closures 40 are filled having liners 70 having numerous different displays. In this manner, a pharmacy may order a box of closures having, for example, ten different advertising messages specifically tailored to that particular pharmacy by providing ten different advertising messages on the liners 70. The pharmacist may then choose which closure should be used to fill the prescription based on the message the pharmacist would like to provide to the patient.

The liners 70 may also be printed "on demand" by the pharmacist or provided to the pharmacist for selectively applying to a closure when filling a prescription. In embodiments in which the liners are printed at the pharmacy, a pharmacy computer preferably includes a database of various liner graphics and information, the graphics/information being chosen from liners 70 substantially as described above. When filling a prescription, the pharmacist chooses one or more of the designs from the database to be printed on the liners. In preferred embodiments, the liners 70 will be printed on a label sheet also including labels having prescription information that is typically applied to the body 13 of the container 12. Alternatively, numerous liners 70 containing different graphics and information are pre-printed by the pharmacist or provided to pharmacist by a third party. In either of these manners, the pharmacist can choose from a variety of different liners having various information based on such factors as the patient, the type of prescription, current promotions, etc., and the pharmacist can selectively apply liners 70 to the closure 40 when filling the prescription.

In another aspect of the closure system 10, the divider 50 is disposed between the first section 42 and second section 46 such that the divider 50 forms a close fit around the opening edge 20 and opening 22 of the container 12 whether the reversible child resistant closure system 10 is in the child resistant mode or the non-child resistant mode. Further, no part of the closure 40 traverses or extends into the opening 22 whether the reversible child resistant closure system 10 is in the child resistant mode or the non-child resistant mode. Accordingly, the present disclosure provides a one piece reversible child resistant closure system 10 that may be used in conjunction with an induction sealing system for providing a tamper resistant seal to the closure system 10. In operation, a tamper resistant liner is inserted into one of the sections 42, 46 of the closure 40. The closure 40 is then applied to the container 12 in the desired configuration, and the closure system 10 is passed through an induction sealing machine for sealing the tamper resistant liner to the opening edge 20 of the container 12.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A closure for use with a container having a neck including a container engaging structure and a container locking mechanism, the closure having a child resistant mode when applied to the container in a child resistant configuration and a non-child resistant mode when applied to the container in a non-child resistant configuration, the closure comprising:

a circumferential side wall having an interior surface;

a first section including a first closure engaging structure disposed on the interior surface of the circumferential side wall configured to contact and interact with the container engaging structure when the closure is in the non-child resistant configuration;

a second section including a second closure engaging structure disposed on the interior surface of the circumferential side wall configured to contact and interact with the container engaging structure when the closure is in the child resistant configuration and a closure locking mechanism configured to engage the container locking mechanism for restricting axial movement of the closure with respect to the container when the closure is in the child resistant mode; and a solid divider disposed between the first section and the second section for closing an opening of the container when the closure is installed on the container in the non-child resistant mode and the child resistant mode, wherein the circumferential side wall, first section, second section, and divider are formed as a unitary one-piece closure.

2. The closure of claim 1, wherein the first closure engaging structure is a continuous thread and the second closure engaging structure is a segmented thread.

3. The closure of claim 1, wherein the first closure engaging structure and the second closure engaging structure are segmented threads.

4. The closure of claim 1, wherein no part of the closure extends into the opening of the container when the closure is installed on the container in the child resistant mode and the non-child resistant mode.

5. The closure of claim 4, further comprising a tamper resistant liner configured to be inserted adjacent the divider in one of the first section and the second section for sealing the opening of the container in an induction sealing process.

6. The closure of claim 1, wherein warning indicia is molded into the divider such that the warning information is visible when the closure is in the non-child resistant mode.

7. The closure of claim 1, further comprising a first liner and a second liner, the first liner configured to be inserted into the first section such that the first liner is visible when the closure is installed on the container in the child resistant mode and the second liner configured to be inserted into the second section such that the second liner is visible when the closure is installed on the container in the non-child resistant mode.

8. The closure of claim 7, wherein the second liner includes warning indicia indicating that the closure is in the non-child resistant mode.

9. The closure of claim 1, wherein the divider is at least partially see-through.

10. The closure of claim 9, further comprising a liner including a first side and a second side, the liner configured to be inserted in one of the first section and the second section such that the first side is viewable when the closure is installed on the container in the non-child resistant mode and the second side is viewable when the closure is installed on the container in the child resistant mode.

11. The closure of claim 10, wherein the first side of the liner includes warning indicia indicating that the closure is in the non-child resistant mode.

12. A reversible child resistant closure system having a child resistant mode and a non-child resistant mode, the reversible child resistant closure system comprising:

a container having a neck including a container engaging structure disposed on an outer surface of the neck and a container locking mechanism;

a unitary one piece closure including:

a circumferential side wall having an interior surface;

a first section having a first closure engaging structure disposed on the interior surface of the circumferential side wall configured to contact and interact with the container engaging structure when the closure is installed on the container in a non-child resistant configuration;

a second section including a second closure engaging structure disposed on the interior surface of the circumferential side wall configured to contact and interact with the container engaging structure when the closure is installed on the container in a child resistant configuration and a closure locking mechanism configured to engage the container locking mechanism for restricting axial movement of the closure with respect to the container when the closure is installed on the container in the child resistant mode; and a solid divider disposed between the first section and the second section for closing an opening of the container when the closure is installed on the container in the non-child resistant mode and the child resistant mode.

13. The closure system of claim 12, wherein the container is injection molded.

14. The closure system of claim 12, wherein the container is blow molded.

15. The closure system of claim 12, wherein the first closure engaging structure is a continuous thread and the second closure engaging structure is a segmented thread.

16. The closure system of claim 12, wherein the first closure engaging structure and the second closure engaging structure are segmented threads.

17. The closure system of claim 12, wherein no part of the closure extends into the opening of the container when the closure is installed on the container in the child resistant mode and the non-child resistant mode.

18. The closure system of claim 17, further comprising a tamper resistant liner configured to be inserted adjacent the divider in one of the first section and the second section for sealing the opening of the container in an induction sealing process.

19. The closure system of claim 12, wherein warning indicia is molded into the divider such that the warning information is visible when the closure is installed on the container in the non-child resistant mode.

20. The closure system of claim 12, further comprising a first liner and a second liner, the first liner configured to be inserted into the first section such that the first liner is visible when the closure is installed on the container in the child resistant mode and the second liner configured to be inserted into the second section such that the second liner is visible when the closure is installed on the container in the non-child resistant mode.

21. The closure system of claim 20, wherein the second liner includes warning indicia indicating that the closure is in the non-child resistant mode.

22. The closure system of claim 12, wherein the divider is at least partially see-through.

23. The closure system of claim 22, further comprising a liner including a first side and a second side, the liner configured to be inserted in one of the first section and the second section such that the first side is viewable when the closure is installed on the container in the non-child resistant mode and the second side is viewable when the closure is installed on the container in the child resistant mode.

24. The closure system of claim 23, wherein the first side of the liner includes warning indicia indicating that the closure is in the non-child resistant mode.

25. A closure for use with a container having a neck including a container engaging structure and a container locking mechanism, the closure having a child resistant mode when applied to the container in a child resistant configuration and a non-child resistant mode when applied to the container in a non-child resistant configuration, the closure comprising:

a circumferential side wall having an interior surface;

a first section including a first engaging thread disposed on the interior surface of the circumferential side wall configured to interact with the container engaging structure when the closure is installed on the container in the non-child resistant configuration;

a second section including a second engaging thread disposed on the interior surface of the circumferential side wall configured to interact with the container engaging structure when the closure is installed on the container in the child resistant configuration and a closure locking mechanism configured to engage the container locking mechanism for restricting axial movement of the closure with respect to the container when the closure is installed on the container in the child resistant mode;

a solid divider disposed between the first section and the second section for closing an opening of the container when the closure is installed on the container in the non-child resistant mode and the child resistant mode;

a first liner disposed in the first section having first liner indicia printed thereon such that the first liner indicia is visible when the closure is installed on the container in the child resistant mode; and a second liner disposed in the second section having second liner indicia printed thereon such that the second liner indicia is visible when the closure is installed on the container in the non-child resistant mode.

26. The closure of claim 25, wherein the circumferential side wall, first section, second section, and divider are formed as a unitary one-piece closure.

27. The closure of claim 25, wherein the first engaging thread is a continuous thread and the second engaging thread is a segmented thread.

28. The closure of claim 25, wherein the first engaging thread is a segmented thread and the second engaging thread is a segmented thread.

29. The closure of claim 25, further comprising a tamper resistant liner configured to be inserted adjacent the divider in one of the first section and the second section for sealing the opening of the container in an induction sealing process.

30. The closure of claim 25, wherein the second liner indicia includes warning indicia indicating that the closure is in the non-child resistant mode.

31. The closure of claim 30, wherein the first liner indicia includes promotional information.

32. A closure for use with a container having a neck including a container engaging structure and a container locking mechanism, the closure having a child resistant mode when applied to the container in a child resistant configuration and a non-child resistant mode when applied to the container in a non-child resistant configuration, the closure comprising:

a circumferential side wall having an interior surface, the circumferential side wall being substantially opaque;

a first section including a first closure engaging structure disposed on the interior surface of the circumferential side wall configured to contact and interact with the container engaging structure when the closure is in the non-child resistant configuration;

a second section including a second closure engaging structure disposed on the interior surface of the circumferential side wall configured to contact and interact with the container engaging structure when the closure is in the child resistant configuration and a closure locking mechanism configured to engage the container locking mechanism for restricting axial movement of the closure with respect to the container when the closure is in the child resistant mode; and a solid divider disposed between the first section and the second section for closing an opening of the container when the closure is installed on the container in the non-child resistant mode and the child resistant mode, the solid divider being at least partially transparent.

33. The closure of claim 32, wherein the circumferential side wall, first section, second section, and divider are formed as a unitary one-piece closure.

34. The closure of claim 32, wherein the first engaging thread is a continuous thread and the second engaging thread is a segmented thread.

35. The closure of claim 32, wherein the first engaging thread is a segmented thread and the second engaging thread is a segmented thread.

36. The closure system of claim 32, further comprising a liner including a first side and a second side, the liner configured to be inserted in one of the first section and the second section such that the first side is viewable when the closure is installed on the container in the non-child resistant mode and the second side is viewable when the closure is installed on the container in the child resistant mode.

* * * * *